US005705467A

United States Patent [19]

Choy

[11] Patent Number: 5,705,467

[45] Date of Patent: Jan. 6, 1998

[54] THICKENED AQUEOUS CLEANING COMPOSITIONS AND METHODS OF USE

[76] Inventor: Clement K. Choy, 1345 Sugarloaf Dr., Alamo, Calif. 94507

[21] Appl. No.: 552,418

[22] Filed: Nov. 3, 1995

Related U.S. Application Data

[60] Division of Ser. No. 179,781, Jan. 11, 1994, abandoned, which is a continuation-in-part of Ser. No. 780,360, Oct. 22, 1991, Pat. No. 5,279,758.

[51] Int. Cl.[6] ..... C11D 1/24; C11D 1/22; C11D 1/29; B08B 3/08

[52] U.S. Cl. ..... 510/370; 510/195; 510/239; 510/365; 510/199; 510/238; 510/380; 510/383; 510/431; 510/427; 134/42; 134/39; 134/40

[58] Field of Search ..... 252/551, 174.14, 252/104, 532, 139, 553, DIG. 4, DIG. 14; 510/370, 195, 239, 365, 199, 238, 380, 383, 431, 427; 134/42, 39, 40

[56] References Cited

U.S. PATENT DOCUMENTS

| | | | |
|---|---|---|---|
| 3,560,389 | 2/1971 | Hunting | 252/95 |
| 3,953,386 | 4/1976 | Murphy et al. | 524/716 |
| 4,071,463 | 1/1978 | Steinhauer | 252/103 |
| 4,116,849 | 9/1978 | Leikhim | 252/103 |
| 4,116,851 | 9/1978 | Rupe et al. | 252/103 |
| 4,164,477 | 8/1979 | Whitley | 252/99 |
| 4,287,080 | 9/1981 | Siklosi | 252/139 |
| 4,337,163 | 6/1982 | Schilp | 252/96 |
| 4,371,461 | 2/1983 | Jones et al. | 252/551 |
| 4,388,204 | 6/1983 | Dimond et al. | 252/DIG. 14 |
| 4,414,128 | 11/1983 | Goffinet | 252/111 |
| 4,418,055 | 11/1983 | Anderson et al. | 424/126 |
| 4,508,633 | 4/1985 | Strempel et al. | 252/135 |
| 4,576,728 | 3/1986 | Stoddart | 252/102 |
| 4,588,514 | 5/1986 | Jones et al. | 252/98 |
| 4,690,779 | 9/1987 | Baker et al. | 252/551 |
| 4,704,226 | 11/1987 | Naylor | 252/162 |
| 4,758,377 | 7/1988 | Iding | 252/556 |
| 4,767,563 | 8/1988 | de Buzzaccarini | 252/174.25 |
| 4,775,492 | 10/1988 | Vipond et al. | 252/187.26 |
| 4,783,283 | 11/1988 | Stoddart | 252/547 |
| 4,789,495 | 12/1988 | Cahall et al. | 252/95 |
| 4,842,757 | 6/1989 | Reboa | 252/76 |
| 4,908,215 | 3/1990 | Perlman | 424/661 |
| 4,911,736 | 3/1990 | Huang et al. | 44/51 |
| 4,919,839 | 4/1990 | Durbut et al. | 252/551 |
| 5,215,683 | 6/1993 | Kravetz et al. | 252/DIG. 14 |
| 5,510,052 | 4/1996 | McCandlish | 252/174.12 |
| 5,597,793 | 1/1997 | Besse et al. | 510/434 |

FOREIGN PATENT DOCUMENTS

| | | |
|---|---|---|
| 0030401 | 11/1980 | European Pat. Off. . |
| 0079697 | 5/1983 | European Pat. Off. . |
| 079697 | 5/1983 | European Pat. Off. . |
| 0110544 | 6/1984 | European Pat. Off. . |
| 110544 | 6/1984 | European Pat. Off. . |
| 0129980 | 1/1985 | European Pat. Off. . |
| 129980 | 1/1985 | European Pat. Off. . |
| 0137871 | 4/1985 | European Pat. Off. . |
| 0204472 | 10/1986 | European Pat. Off. . |
| 0233666 | 8/1987 | European Pat. Off. . |
| 57-168999 | 10/1982 | Japan . |
| 2158456 | 11/1985 | United Kingdom . |
| 8601823 | 3/1987 | WIPO . |

OTHER PUBLICATIONS

McCutcheons: Emulsifiers and Detergents, North American Ed. (1985) McCutcheon Division Publishing, p. 285.

*McCutcheon's Emulsifiers & Detergents*, North American Edition, 1985, Month not known, McCutcheon Division, McPublishing Co., p. 285.

*Primary Examiner*—Douglas J. McGinty

*Attorney, Agent, or Firm*—Sharon R. Kantor; Michael J. Mazza

[57] ABSTRACT

Aqueous cleaning compositions and methods of use are disclosed with a thickening agent including an alkyl ether sulfate surfactant forming about 0.1 to about 10% by wt. of the composition, about 0.1–5.0% by wt. of a cothickening surfactant comprising an alkali metal fatty acid sulfate and/or an alkoxylated alkylphenol sulfate salt, a solvent selected from the class consisting of terpene derivatives including a functional group and tertiary alcohols forming about 0.01 to about 10% by wt. of the composition and an electrolyte component in an amount effective for enhancing thickening effects of the alkyl ether sulfate surfactant and solvent. The electrolyte component preferably includes an alkali metal hypochlorite, more preferably at least one additional multivalent electrolyte, and most preferably sodium carbonate. With the electrolyte component including a hypochlorite, additional electrolytes and the solvent are selected to be bleach stable, the solvent also preferably being a fragrance for the composition.

16 Claims, 4 Drawing Sheets

THICKENED AQUEOUS CLEANING COMPOSITIONS AND METHODS OF USE

CROSS-REFERENCE TO OTHER APPLICATIONS

This is a divisional of U.S. Ser. No. 08/179,781, filed 11 Jan. 1994, abandoned, which is a Continuation-in-Part of Ser. No. 07/780,360 filed Oct. 22, 1991, which issued as U.S. Pat. No. 5,279,758 on 18 Jan. 1994, and is commonly owned herewith.

FIELD OF THE INVENTION

The present invention relates to thickened aqueous cleaning compositions and methods of use.

BACKGROUND OF THE INVENTION

Considerable art has been developed in connection with thickened cleaning compositions, particularly where the compositions include hypochlorite solutions useful in a variety of applications as hard surface cleaners, disinfectants, drain cleaners and the like. The efficacy of such compositions is greatly improved by increased viscosity, for example, to increase the residence time of the composition, especially on non-horizontal surfaces.

In addition, thickening of such liquid compositions is desirable in order to minimize splashing during pouring or application of the composition. At the same time, consumer preference for a thickened product has also been well established. In any event, the term "liquid bleach composition" is employed below to refer generally to liquid compositions intended for bleaching, cleaning, clearing of drains and other related purposes within applications such as but not limited to those summarized above.

The following references disclosed a variety of thickeners for hypochlorite bleach solutions. At the same time, these references disclosed such liquid bleach compositions including various other compounds such as alkyl ether sulfate specifically to serve as surfactants or cosurfactants within the thickened hypochlorite bleach compositions. The importance of this distinction will be apparent in connection with the present invention as summarized below.

For example, U.S. Pat. No. 4,337,163 issued Jun. 29, 1982 to Schilp disclosed thickened bleach compositions containing as a thickening agent 0.5–5% by wt. of a mixture of (1) a hypochlorite-soluble first detergent active compound selected from the group consisting of tertiary amine oxides, betaines, quaternary ammonium compounds and mixtures thereof, and (2) a second detergent active compound selected from the group consisting of surfactants including an alkali metal $C_{10-18}$ alkyl ether sulfate containing 1–10 moles of ethylene oxide and/or propylene oxide and mixtures thereof, the weight ratio of the first and second compounds being from 75:25 to 40:60, the composition further comprising from 50–350 m mole/kg of a buffer salt selected from a further defined class. The tertiary amine oxide of the first group is the preferred thickener for the composition. (Also see related EP030401.)

The above reference is generally representative of a number of other references disclosing the use of alkyl ether sulfates in surfactant systems for thickened hypochlorite solutions. For example, U.S. Pat. No. 4,388,204 to Dimond et al. disclosed a thickened composition with a surfactant mixture of 10–50% sarcosinate; 3–40% alkyl ether sulfate and 30–75% alkylsulfate. Carlton et al. in EP 137871 disclosed a thick hypochlorite solution in which 0–3% of the composition was a surfactant comprising 80–99.9% amine oxide and 0.1–20% of an anionic surfactant selected from a group including alkyl ether sulfate.

LaCroix et al., in WO 86/01823, disclosed a thickened hypochlorite solution with less than 4% amine oxide and one or more cosurfactants selected from the group of sarcosinate, alkyl ether sulfate and alkylsulfonate in amounts less than that recited for amine oxide. EP233666 to Vipond et al. disclosed a hypochlorite solution with a $C_{8-20}$ soap precursor for in situ development of viscosity and amine oxide which could allegedly be replaced by one of a number of hypochlorite soluble surfactants including alkyl ether sulfate.

U.S. Pat. No. 4,588,514 issued to Jones et al. disclosed a thickened hypochlorite solution with a surfactant system including relatively large amounts of amine oxides, soaps or sarcosinates for thickening and a lesser amount of alkyl ether sulfate for storage stability. Stoddart U.S. Pat. No. 4,576,728 also disclosed a thickened hypochlorite solution with amine oxide, optionally betaine in an amount equal to the amine oxide and an anionic surfactant selected from a group including alkyl ether sulfate and forming 0.1–20% of the total surfactant. (Also see related EP204472.)

JP 57168999 disclosed hypochlorite solutions thickened with expansive clay and including a surfactant such as alkylphenylether sulfate.

EP79697 to Francis employed $C_{13-18}$ alkyl dimethylamine oxides to thicken hypochlorite solutions with ionic strengths greater than 3 g-mole/liter. EP110544 to Nelson employed $C_{14}$ or greater alkyl amine oxides and added salt to thicken bleach. Extra salt was not needed if $C_{16}$ or greater alkyl amine oxide were present but a shorter chain amine oxide was also needed. From a practical point of view, this is considered the same as employing two different surfactant types.

A variety of thickeners found suitable for use with hypochlorite solutions have been disclosed for example by Rupe et al. in U.S. Pat. No. 4,116,851 which disclosed a clay thickened hypochlorite bleach which could also include other thickening agents of a polymeric type such as polystyrene, polypropylene, polyethylene or copolymers of styrene with, for example, acrylate, maleate or vinyl acetate. A similar variety of additional thickeners were disclosed by Leikhim in U.S. Pat. No. 4,116,849.

SUMMARY OF THE INVENTION

Although compositions such as those disclosed above have been found suitable for their intended purposes, there has been found to remain a need for thickened aqueous cleaning compositions for use in a variety, of applications and which offer improvements either on the basis of performance, cost or ease of manufacture.

More specifically, it is an object of the invention to provide such improved thickened aqueous cleaning compositions and methods of use therefor.

It is a related object of the invention to provide such thickened aqueous cleaning compositions which are stable over a typical storage shelf life and/or which are capable of formulation at relatively low cost.

It is a more specific object of the invention to provide a thickened aqueous cleaning composition and methods of use wherein the composition comprises about 0.1 to about 10% by wt., preferably about 0.5–2.0% by wt., of an alkyl ether sulfate surfactant; about 0.1–5.0%, preferably 0.1–2.5%, by wt., of a cothickening surfactant; a solvent selected from the class consisting of terpene derivatives including a functional group and tertiary alcohols, the solvent forming from about 0.01 to about 10% by wt. of the composition, and an electrolyte component in an amount effective to enhance thickening by the alkyl ether sulfate surfactant and solvent. It is broadly contemplated that the electrolyte component forms about 0.1 to about 30% by wt. of the composition.

In one embodiment of the invention as defined above, the alkyl ether sulfate surfactant has an alkyl component with about 8–18 carbons and an alkylene oxide component, preferably ethylene oxide, with about 1–4 alkylene oxide monomers. The alkyl component is preferably a linear chain and also more preferably contains about 12–16 carbons. The alkyl ether sulfate surfactant is an essential component of the thickening agent together with the cothickening surfactant and solvent specified above, the combination of the alkyl ether sulfate surfactants and solvent surprisingly providing effective thickening for such electrolyte solutions which cannot be achieved by other surfactants even in combination with the same solvents.

The thickened aqueous cleaning composition of the invention may include a variety of different electrolytes with the same thickening effect being achieved. However, the invention more preferably contemplates the electrolyte component as including a hypochlorite of an alkali metal so that the composition is effective for various bleach applications. With or without the hypochlorite, the electrolyte preferably comprises at least one multivalent electrolyte in order to further enhance thickening realized by the combination of the alkyl ether sulfate and the solvent. A particularly preferred multivalent electrolyte is sodium carbonate.

Particularly where the aqueous cleaning composition includes an alkali metal hypochlorite, the composition also preferably includes yet another electrolyte which is a source of alkalinity, such as sodium hydroxide, causing the composition or solution to have a pH of at least about 10.5, preferably at least about 11–11.5 and more preferably at least about 12. The hypochlorite also more preferably forms about 1–6% by wt. of the composition. The composition may also contain a hydrotrope or solubilizing agent and one or more bleach stable cosurfactants for purposes other than thickening. The composition may also include other adjuncts typical for use in specific applications such as those set forth above.

Aqueous cleaning compositions or liquid bleach solutions thickened with a combination of an alkyl ether sulfate surfactant, a solvent and an electrolyte component as summarized above have been found to be smooth flowing and relatively transparent, at least at room temperature.

Where the electrolyte component includes a hypochlorite bleach, both the solvent and any additional electrolytes are selected to be bleach stable. In connection with the solvents specified above, the tertiary alcohols tend to be bleach stable while saturated forms of the terpene derivatives are also bleach stable.

Additional objects and advantages of the invention are made apparent, at least to those skilled in the art, in the following description having reference to the drawings described immediately below.

DETAILED DESCRIPTION OF THE PREFERRED EMBODIMENTS

Figure 1:
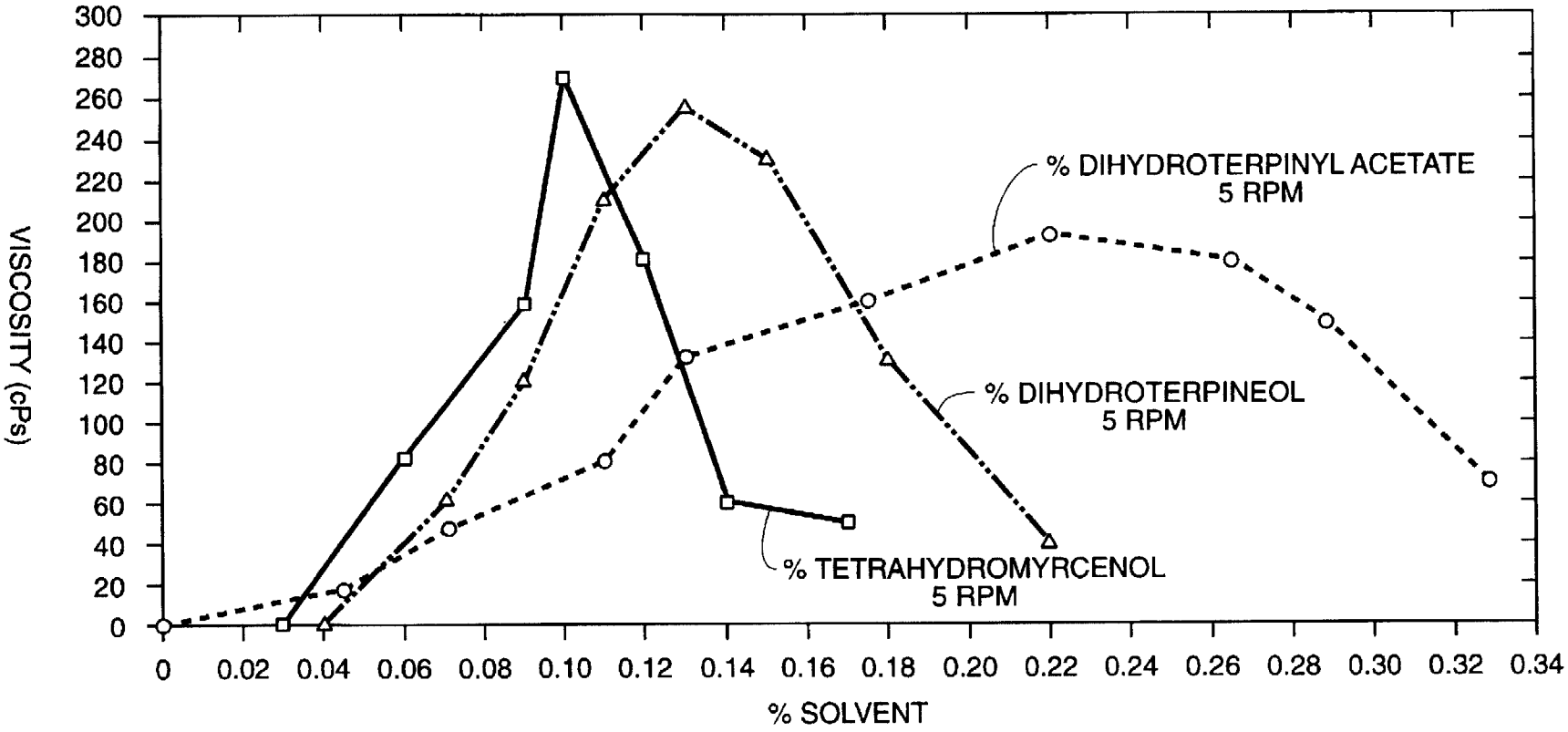
FIG. 1 is a graphical representation illustrating the effect of varying amounts of different solvents in combination with an alkyl ether sulfate surfactant and an electrolyte component to thicken aqueous cleaning or bleach compositions according to the invention.

Different embodiments of the present invention commonly relate to aqueous cleaning compositions which may be employed for a variety of specific applications. The aqueous cleaning composition may include an alkali metal hypochlorite so that the composition is effective for bleaching applications. In any event, the invention essentially contemplates a thickening agent comprising in combination an alkyl ether sulfate surfactant (AEOS), a solvent selected from the class consisting of terpene derivatives including a functional group and tertiary alcohols and an electrolyte component. It is to be noted that unless otherwise stated, all percentages are weight percentages of actives.

The alkyl ether sulfate surfactant generally forms from about 0.1 to about 10% by wt. of the composition, preferably from about 0.25 to about 3% by wt. of the composition and most preferably from about 0.5 to about 1.5% by wt. of the composition. The solvent generally forms from about 0.01 to about 10% by wt. of the composition, preferably from about 0.05 to about 0.5% by wt. of the composition and most preferably from about 0.1 to about 0.2% by wt. of the composition. The electrolyte component generally forms from about 0.1 to about 30% by wt., preferably from about 1 to about 12% by wt. and most preferably from about 2 to about 6% by wt. of the composition. As noted above, the electrolyte component may include an alkali metal hypochlorite forming about 0.1 to about 10% by wt. of the composition.

The above combination of an alkyl ether sulfate surfactant, a solvent as specified above and an electrolyte component have been found important to form the thickening agent of the invention. It has been surprisingly found that an alkali metal $C_{6-18}$ alkyl sulfate, an alkoxylated alkylphenol sulfate salt, or a mixture thereof, provides a synergistic improvement in thickening. Accordingly, it is again emphasized that the combination of an alkyl ether sulfate surfactant, a cothickening surfactant, a solvent as specified above and an electrolyte component has been found essential to achieve the novel thickening effects realized by the present invention.

Additional bleach stable cosurfactants may also be included in the compositions of the invention for purposes other than thickening. It is also possible that the compositions may include other cosurfactants or non-surfactant cothickeners as long as the novel combination of the alkyl ether sulfate surfactant, cothickening surfactant and solvent and electrolyte combination are employed according to the present invention.

Other substituents or adjuncts may be included in the various embodiments of the liquid bleach compositions of the present invention, particularly depending upon the specific application contemplated for the composition. For example, such adjuncts may include a source of alkalinity for adjusting pH of the composition, electrolytes, buffers, builders, fragrances, colorants, fluorescent whitening agents (FWA), etc.

In the following description, essential substituents of the composition are first described in detail below followed by other possible adjuncts in the composition. Thereafter, an experimental section is set forth with a number of examples corresponding with various embodiments of the invention.

The invention contemplates an electrolyte component which may be in the form of hypochlorite bleach as defined in greater detail below and/or other electrolyte components useful by themselves or in combination with the hypochlorite bleach. In this regard, it is to be noted that the electrolyte components may function in combination with the novel combination of the alkyl ether sulfate surfactant and specified solvent combination in order to even further enhance thickening effects in the composition. Multivalent electrolytes, including hypochlorite bleaches, are preferred in combination with the thickening agent of the invention to further enhance thickening of the resulting compositions.

The electrolyte component is believed important as part of the thickening agent for the present invention based upon its ionic strength. In this regard, ionic strength in the aqueous cleaning composition or solution is provided by the hypochlorite bleach together with salts typically accompanying the hypochlorite bleach. However, it is to be noted that hypochlorite bleach may be included in the composition without accompanying salts. In any event, other non-surface active organic or inorganic compounds can be added in order to provide ionic strength for the composition or solution of the invention in accordance with the following description.

Generally, the term "electrolyte" is employed herein to include substantially all ionizable species. Ionizable compounds as contemplated herein may be inorganic in nature, e.g., alkali metal or ammonium hydroxide, sulphate, halide, (particularly chloride), silicate, carbonate, nitrate, orthophosphate, pyrophosphate, or polyphosphate, or organic such as formate, acetate or succinate. The ionizable alkali metal compound normally comprises a caustic alkali such as sodium or potassium hydroxide either alone or in admixture with alkali metal salts.

In the preferred embodiments of the invention, organic compounds incorporating oxidizable groups are avoided because of their tendency to have adverse effects on physical and/or chemical stability of the compositions on storage. Certain organic sequestrants such as the amino poly (alkylene phosphonates) salts can, however, be incorporated in an oxidized form in which they are not susceptible to attack by the hypochlorite bleach. Such sequestrants are normally present in amounts of from about 0.1% to about 0.5% by wt. of the composition.

The ionic strength of the composition is calculated by means of the expression $$\text{Total Ionic Strength } I = \Sigma \frac{(C_i Z_i)^2}{2}$$

where $C_i$ is the molar concentration of the ionic species in g moles/dm$^3$, and $Z_i$ is the valency of the species.

The function $C_i Z_i^2$ is calculated for each of the ionic species in solution, these functions are summed and divided by two to give the composition ionic strength.

In some formulations contemplated by the present invention, it may be important to provide a source of alkalinity such as carbonate, silicate, hydroxide, tri- or di-basic phosphate salts. The carbonate salts are most preferred as the electrolyte as carbonate salts maximize viscosity development for any given total ionic strength. Particularly preferred are alkali metal carbonates. The thickening agent of the invention is contemplated for solutions forming a broad pH range of about 1 to 14. However, when hypochlorite is present, the pH is preferably raised. A strong base such as sodium hydroxide is preferred in order to properly adjust the pH of the composition. As noted above, such a strong base is added in sufficient quantities to raise the pH of the composition or solution generally above about 10.5, preferably above about 11–11.5 and more preferably above about 12. These materials are also electrolytes or ionizable compounds as discussed above.

As noted above, electrolytes may also be added to the composition of the present invention either alone or in combination with a buffer or buffers.

Low levels of electrolytes such as sodium chloride or sodium sulfate function to provide ions in aqueous solution and have been shown to measurably improve solution viscosity under certain conditions. Sodium hypochlorite advantageously includes some sodium chloride formed during manufacture. Sodium chloride may also be added to bleaches or sodium hypochlorite solutions for increasing ionic strength. However, with the binary or ternary surfactant system, one of the advantages of the invention is the reduced need for such an electrolyte. However, it is to be understood that electrolyte may be included, for example, particularly if necessary in combination with cosurfactants or cothickeners employed in the invention to supplement primary thickening accomplished by the alkyl ether sulfate.

Buffers act to maintain pH in the composition or solution. As noted above, an alkaline pH is favored for attaining increased viscosity and for maintaining hypochlorite stability in order to enhance bleach effectiveness over time. Most compounds serve as both buffer and electrolyte. Some also serve as builders, as is known in the art. These particular buffer-electrolyte compounds are generally the alkali metal salts of various inorganic acids such as alkali metal phosphates, polyphosphates, pyrophosphates, triphosphates, tetraphosphates, silicates, metasilicates, polysilicates, carbonates, hydroxides and mixtures thereof.

Sodium hydroxide may be preferred in terms of its ability to provide free alkali and to aid in stabilizing hypochlorite bleaches. Sodium hydroxide or caustic may be added in amounts from about 0.05% to 5.0%, preferably about 0.25% to 2.0%. The caustic percentage is generally maintained in the same range as the surfactant percentage in accordance with the preceding discussion for optimum stability.

As noted above, the aqueous cleaning solution of the invention preferably includes a hypochlorite bleach in an amount equal to from about 0.1% to about 10% by wt. of the composition. Generally, the hypochlorite component of the aqueous cleaning composition may be provided by a variety of sources. Hypochlorite compounds or compounds producing hypochlorite in aqueous solution are preferred (although hypobromite compounds or hypobromite precursors may also be suitable). Representative hypochlorite-producing compounds include sodium, potassium, lithium and calcium hypochlorite, chlorinated trisodium phosphate dodecahydrate, potassium and sodium dichloroisocyanurate and trichlorocyanuric acid. Other N-chloro imides, N-chloro amides, N-chloro amines and chloro hydantoins are also suitable.

The alkyl ether sulfate component of the invention preferably includes an alkyl component with about 8–18 carbons and an alkylene oxide component with about 1–4 alkylene oxide monomers. The alkyl component may be either of a branched or linear chain type, although linear alkyl components are generally preferred. At the same time, the alkylene oxide component may be comprised, for example, of ethylene oxide or propylene oxide, for example, although ethylene oxide is the preferred alkylene oxide component.

Especially where the alkyl component is linear, it preferably contains about 12–16 carbons. It should also be noted that the preferred number of carbons in the alkyl component tends to increase for branched chains as compared to linear chains, at least where the number of alkylene oxide units remains the same. Generally, branched chains, for example, methyl groups, do not influence overall properties of the alkyl component as much as those properties can be varied by adding one or more carbons to the linear chain of the alkyl component. Alkoxy and halogen substituents are also suitable.

Accordingly, the alkyl ether sulfate surfactant selected to function with the specified solvent in the thickening agent of the invention may have a general structure as shown below:

$$CH_3(CH_2)_n—CH_2—O(CH_2CH_2—O)_mSO_3^-X^+$$

wherein n equals 6–16, preferably 10–14 (at least for linear chain types), m equals 1–4 and X equals sodium, potassium or other bleach stable cations.

Thickening is synergistically improved by employing a combination of thickening-effective surfactants, in combination with the solvent and electrolyte. Thus the alkyl ether sulfate surfactant is combined with a $C_{6-18}$, preferably $C_{12-16}$, fatty acid sulfate salt, an alkoxylated alkylphenol sulfate salt, or a mixture of both. The fatty acid sulfate salt is more preferably acetyl, lauryl or myristryl and most preferably is lauryl. Suitable commercially-available examples include STEPANOL™ WA and WAC series, sold by The Stepan Company, and CARSONAL™ SLS, sold by Lonza Inc. The alkylphenol sulfate salt may have a $C_{6-18}$, preferably a $C_{6-12}$, alkyl group, and more preferably is octyl or nonyl. More preferred is an ethoxylated alkylphenol sulfate salt having 3–15 ethoxy groups per molecule, and most preferred is 6.5 to 10 ethoxy groups per molecule. Examples include nonyl and octyl ethoxylated alkyphenol sulfate salts sold by Union Carbide under the trademark TRITON™ N and X, as well as Union Carbide's TERGITOL™ series and Texaco Chemical Co.'s SURFONIC™ series.

Solvents employed as part of the thickening agent for the present invention, as noted above, are selected from the class consisting of terpene derivatives including a functional group and tertiary alcohols. It is incidentally noted that all such compounds tend to have a fragrance effect, some more desirable than others.

For purposes of the present invention, terpene derivatives are effective for purposes of the present invention only if they include a functional group as indicated.

Terpene derivatives contemplated for the present invention include terpene hydrocarbons with a functional group. For purposes of the invention, effective terpenes with functional groups typically include but are not limited to alcohols, ethers, esters, aldehydes and ketones.

Representative examples for each of the above classes include but are not limited to the following. Terpene alcohols include, for example, verbenol, trans-pinocarveol, cis-2-pinanol, nopol, iso-borneol, carbeol, piperitol, thymol, alpha-terpineol, terpinen-4-ol, menthol, 1,8-terpin, dihydroterpineol, nerol, geraniol, linalool, citronellol, hydroxy citronellol, 3,7-dimethyl octanol, dihydro-myrcenol, beta-terpineol, tetrahydro-alloocimenol and perillalcohol. Terpene ethers and esters include, for example, 1,8-cineole, 1,4-cineole, iso-bornyl methylether, rose pyran, alpha-terpinyl methyl ether, menthofuran, trans-anethole, methyl chavicol, allocimene diepoxide, limonene mono-epoxide, iso-bornyl acetate, nopyl acetate, alpha-terpinyl acetate, linalyl acetate, geranyl acetate, citronellyl acetate, dihydroterpinyl acetate and neryl acetate. Terpene aldehydes and ketones include, for example, myrtenal, campholenic aldehyde, perillaldehyde, citronellal, citral, hydroxy citronellal, camphor, verbenone, carvone, dihydro-carvone, carvenone, piperitone, menthone, geranyl acetone, pseudo-ionone, alpha-ionone, beta-ionone, iso-pseudo-methyl ionone, normal-pseudo-methyl ionone, iso-methyl ionone and normal-methyl ionone.

Terpene hydrocarbons with functional groups, as contemplated by the present invention, are discussed in substantially greater detail, for example, by Simonsen & Ross in *The Terpenes,* Volumes I–V, Cambridge University Press, Second Edition 1947. To the extent that reference deals with terpene hydrocarbons with functional groups suitable for use in the thickening agent of the present invention, it is incorporated herein as though set forth in its entirety.

Tertiary alcohols useful as the solvent in the present invention generally have the following molecular structure:

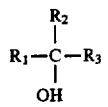

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl aralkyl, alkaryl, and aldehyde moieties, and combinations thereof.

It is of course to be noted that where the electrolyte component of the present invention includes a hypochlorite, the other components of the composition are preferably selected to be bleach stable. In selecting a solvent as defined above, the tertiary alcohols are generally all stable in the presence of bleaches. As for the terpene derivatives, they are preferably selected to be saturated in order to exhibit bleach stability. Generally, unsaturated forms of the terpene derivatives exhibit less satisfactory stability in the presence of hypochlorite bleaches.

As noted above, cosurfactants which are added to the composition either for supplemental thickening or non-thickening purposes (such as cleaning, improving phase stability, etc.) are initially selected upon the basis of being bleach stable. Generally, a wide variety of surfactants may be stable in the presence of bleaches such as hypochlorite in a aqueous solution including but not limited to amine oxides, betaines, sarcosinates, taurates, alkyl sulfates, alkyl sulfonates, alkyl aryl sulfonates, alkyl phenol ether sulfates, alkyl diphenyl oxide sulfonates, alkyl phosphate esters, etc. Generally, such nonthickening cosurfactants may be any of a variety of different types including anionics, non-ionics, amphoterics, etc. A preferred cosurfactant is myristyl dimethyl amine oxide, which is uncharged at the pH of typical bleach solutions.

A further class of examples of preferred anionic cosurfactants is the lauroyl sarcosinates since they are particularly resistant to oxidation by bleach materials such as hypochlorite. Accordingly, these materials are bleach-resistant, even at elevated temperatures. Specific examples include surfactants sold under the trademarks AMMONYX™ MO (lauryl dimethyl amine oxide) and HAMPOSYL™ L (sodium lauroyl sarcosinate). The former is manufactured and marketed by Stepan Chemical Company and the latter by W. R. Grace and Company. Hydrotropes such as toluene sulfonate, xylene sulfonate, cumene sulfonate and alkyl naphthalene sulfonate salts of alkali metals are also useful.

In any event, the specific identity of the cosurfactant is not critical to the present invention as long as it is bleach stable and compatible with the other components of the composition to perform either non-thickening surfactant functions or even supplemental thickening in combination with alkyl ether sulfate as the primary thickener in accordance with the preceding discussion.

Non-surfactant cothickeners, as contemplated in the present invention, may include but are not limited to products such as expansive clays, colloidal silicas, aluminas and bleach resistant polymers.

It is to be understood that the additional components discussed above are selected only to the extent that they do not interfere with the novel thickening effect of the thickening agent comprising the alkyl ether sulfate surfactant and specified solvent.

Compositions formulated in accordance with the present invention may also include other components such as fragrances, coloring agents, fluorescent whitening agents, chelating agents and corrosion inhibitors (to enhance performance, stability and/or aesthetic appeal of the composition). Generally, all of these substituents are also selected with the essential or at least basic characteristic of being bleach or hypochlorite resistant. Although these components are not critical according to the present invention, they are briefly discussed below in order to indicate how they may be included within the composition if desired.

Bleach-resistant fragrances such as those commercially available from International Flavors and Fragrance, Inc. may be included in compositions of the invention in amounts from about 0.01% to about 0.5% of the composition. However, it is to be noted that the specified solvents employed in combination with the alkyl ether sulfate surfactant to form the preferred thickening agent of the present invention also function as fragrances. Accordingly, it may not be necessary to add other fragrances to the compositions.

Bleach-resistant colorants or pigments may also be included in small amounts. Ultramarine Blue (UMB) and copper phthalocyanines are examples of widely used bleach-stable pigments which may be incorporated in the compositions of the present invention.

Suitable builders, as also discussed briefly above, may be optionally included in the compositions of the invention and include but are not limited to carbonates, phosphates and pyrophosphates. Builders function in a manner well known in the art to reduce the concentration of free calcium or magnesium ions in the aqueous solution. Certain of the previously mentioned buffer materials, for example, carbonates, phosphates and pyrophosphates, also function as builders. Typical builders which do not also function as buffers include sodium and potassium tripolyphosphate and sodium or potassium hexametaphosphate. It is also to be noted that the above builders also tend to function as electrolytes and accordingly are to be considered in terms of the preceding discussion concerning electrolytes in the composition.

Before proceeding with the experimental section of the description, it is initially noted that compositions such as those outlined above and set forth in the following examples may be formulated in a relatively simple manner. Usually, the base or source of alkalinity is initially added to the hypochlorite solution in order to adjust its pH and facilitate the introduction of other components. Other components besides the alkyl ether sulfate, cothickening surfactant, solvent and electrolyte, and possibly other cothickeners are then added to the formulation to facilitate their addition at lower viscosities. Finally, the thickeners are added as indicated above. Although such an order of addition during formulation is preferred, it is not an essential requirement of the invention and other orders of addition or methods of formulation may be employed.

The present invention is based upon the discovery of a synergistic thickening effect for cleaning solutions as defined above. Initially, the synergistic thickening effect is based upon the novel thickening agent of the present invention comprising an alkyl ether sulfate surfactant, a cothickening surfactant, a specified solvent which can be either a tertiary alcohol or a terpene derivative and an electrolyte component. Such a synergistic effect is particularly to be observed in connection with multivalent electrolytes. For purposes of the present invention but not to limit the invention, it is theorized that the electrolytes provide a charged medium in which the thickening system comprising the alkyl ether sulfate surfactant, cothickening surfactant and solvent best function to achieve the unexpected thickening effect of the invention.

It is further theorized, again without limiting the invention, that the synergistic effect of the alkyl ether sulfate surfactant, the cothickening surfactant and the solvent is particularly enhanced where the aqueous solubility of the solvent is limited (in water alone) to a solubility of about 1% by wt. Because of this limited solubility, the solvent is partially dependent upon solubilizing effects of the surfactants. For this reason, it is contemplated that the specified surfactants and the solvent, which is relatively insoluble in water, interact to form a novel structure in the electrolyte solutions which provides the observed thickening effect. As noted above, it has been found that other surfactants alone are incapable of providing the same thickening effect in combination with the same solvents and an electrolyte component. At the same time, other solvents have also been found to be ineffective to achieve the novel thickening effect of the invention in combination with the same surfactants and an electrolyte component.

These unique thickening characteristics for the present invention are discussed in greater detail below in connection with certain preferred embodiments set forth in the following experimental section.

Various examples are described below particularly with reference to the graphical representations in the figures.

Initially referring to FIG. 1, three curves are indicated by dotted, dashed and solid lines, respectively, and are illustrative of compositions set forth herein as Examples 1–3, which demonstrate the effects of varying amounts of different solvents upon viscosity of a liquid aqueous cleaning composition according to the present invention.

In the compositions for all of Examples 1–3, a thickening system comprises 1.5% by wt. of an alkyl ether sulfate, for example, available from Henkel Corporation under the trade name TEXAPON N-70, 0.75% by wt. sodium hydroxide (NaOH), 2.3% by wt. sodium hypochlorite bleach (NaOCl) and 1.0% by wt. sodium carbonate ($Na_2CO_3$). In Example 1, the thickening agent also includes a varying amount of dihydroterpinyl acetate. Similarly, the composition of Example 2 includes dihydroterpineol in varying amounts as the solvent while the composition of Example 3 includes tetrahydromyrcenol in varying amounts as the solvent.

FIG. 1 clearly indicates enhanced thickening for a range of each of the above solvents together with other components of the thickening agent, particularly the alkyl ether sulfate surfactant and one or more electrolytes.

Figure 2:
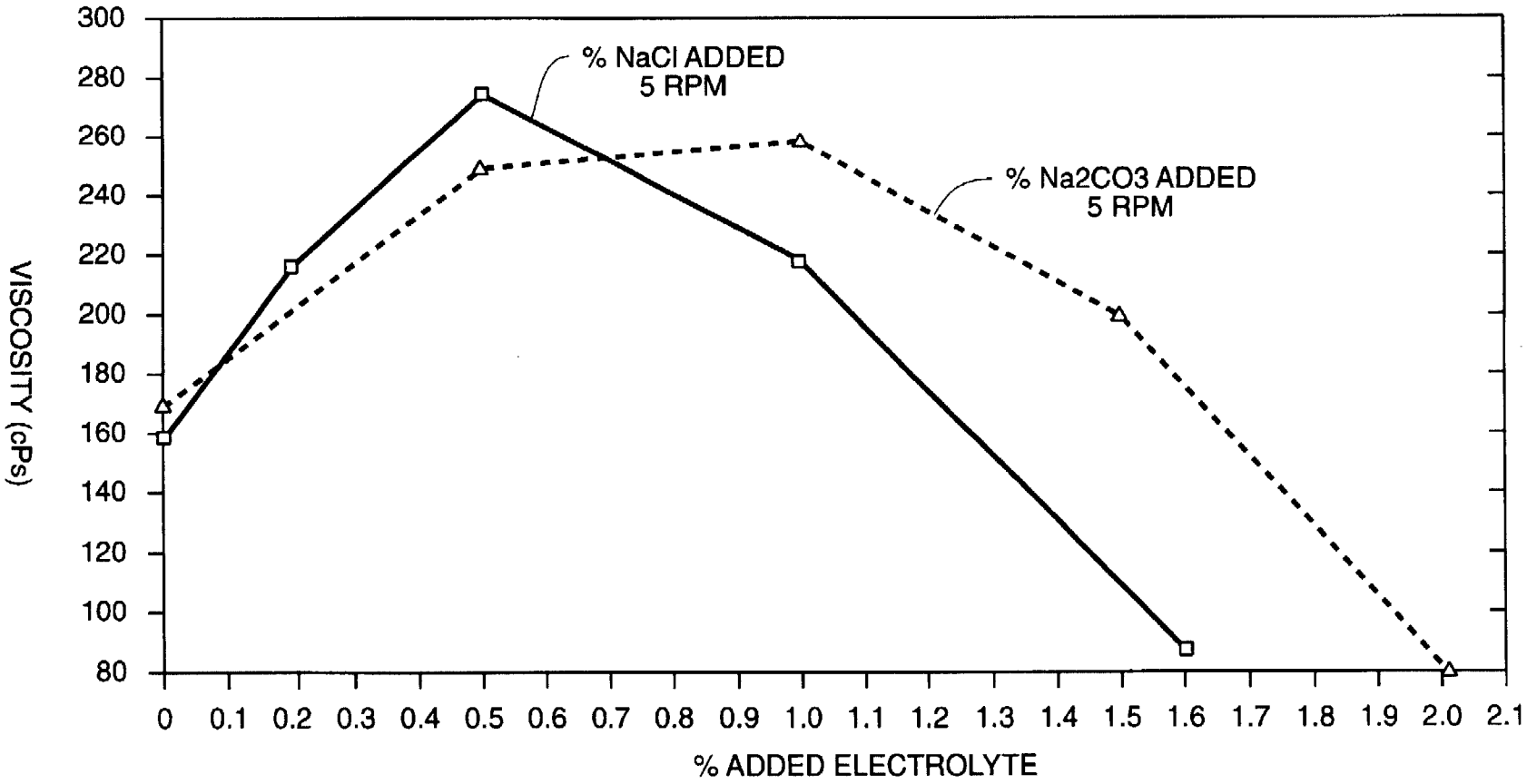
FIG. 2 is a similar graphical representation illustrating the effect of varying amounts of both a monovalent and a multivalent electrolyte added to a thickened aqueous cleaning or bleach composition according to the present invention.
Figure 3:
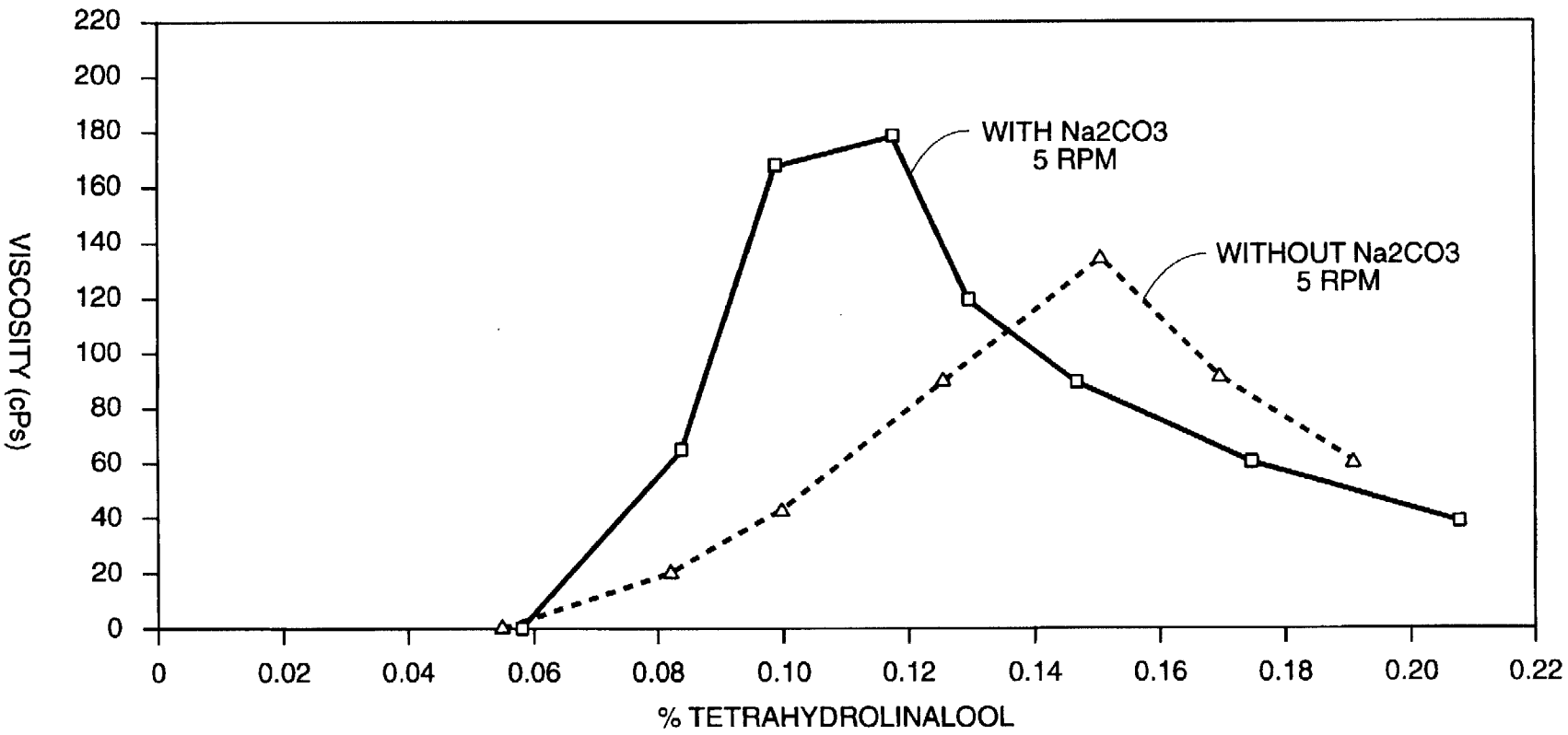
FIG. 3 is another graphical representation illustrating the effects of varying amounts of a single solvent, with and without sodium carbonate as a multivalent electrolyte, in a thickened aqueous cleaning or bleach composition according to the present invention.

The thickening effects illustrated in FIG. 1 for the compositions of FIGS. 1–3 are also representative of thickening effects realized by other solvents selected from the class of terpene derivatives with functional groups and tertiary alcohols as set forth above.

As illustrated in FIG. 1, optimum thickening may be realized with varying amounts of the respective solvents. However, each of the solvents set forth herein generally has a preferred range where it achieves optimum thickening in combination with the alkyl ether sulfate surfactant and electrolyte component of the invention.

It is noted that a further solvent, tetrahydrolinalool, is included in a further example illustrated in FIG. 3. In addition, it is noted that still other solvents within the representative group provide enhanced thickening in combination with the alkyl ether sulfate surfactant and electrolyte component of the invention. For example, isobornyl acetate is also capable of enhancing thickening but to a lesser degree than the solvents included in Examples 1–3. Isobornyl acetate, however, has a stronger fragrance effect than those solvents. Accordingly, isobornyl acetate is noted as a solvent which may possibly be present in the composition more as a fragrance than as a solvent.

The thickening effects of compositions described below as Examples 4 and 5 are graphically illustrated in FIG. 2.

Examples 4 and 5 both include 1.5% by wt. of an alkyl ether sulfate surfactant, specifically TEXAPON N-70 as noted above, 0.75% by wt. sodium hydroxide, 2.3% by wt. sodium hypochlorite bleach and 0.10% of a tetrahydromyrcenol solvent. In addition, Example 4 includes varying amounts of a monovalent electrolyte, namely sodium chloride while Example 5 includes varying amounts of a multivalent electrolyte, namely sodium carbonate (added in powdered form). Note that in both Examples 4 and 5, sodium chloride is present in an amount equal to the sodium hypochlorite.

Referring specifically to FIG. 2, curves illustrating thickening effects for Examples 4 and 5 are indicated, respectively, by solid and dashed lines. A comparison of the two curves illustrates that both of the specified electrolytes have specific ranges in which they enhance thickening in combination with the alkyl ether sulfate surfactant and solvent components of the invention.

More specifically, FIG. 2 also illustrates a general preference for multivalent electrolytes such as sodium carbonate included in Example 5 (dashed line).

Thus, the results illustrated in FIG. 2 are also representative of results for other electrolytes employed in the thickening agent of the present invention.

Thickening effects for compositions set forth herein as Examples 6 and 7 are graphically illustrated in FIG. 3 by dashed and solid lines, respectively.

Each of Examples 6 and 7 includes 1.5% by wt. of an alkyl ether sulfate, specifically TEXAPON N-70 as noted above, 0.75% sodium hydroxide, 2.3% sodium hypochlorite bleach and a varying amount of a tetrahydrolinalool solvent. The amount of tetrahydrolinalool is graphically represented for each of the examples in FIG. 3. Example 7, indicated by the solid line in FIG. 3, also includes 1.0% by wt. of sodium carbonate.

Accordingly, the two traces in FIG. 3 generally illustrate the effectiveness of the thickening agent of the present invention comprising in combination an alkyl ether sulfate surfactant, a solvent as specified above and an electrolyte. It is noted again that, in both Examples 6 and 7, the electrolyte component comprises both sodium hydroxide and sodium hypochlorite bleach. In addition, Example 7 includes sodium carbonate as noted above. Accordingly, FIG. 3 illustrates the effectiveness of a multivalent electrolyte in enhancing thickening effects. In this regard, note that the thickness achieved by the composition of Example 7 is greater than that achieved by the composition of Example 6. At the same time, it is also noted that the optimum thickening range for the solvent is shifted to the left along the X axis of FIG. 3 with the addition of the multivalent electrolyte. In other words, optimum thickening in the presence of a divalent electrolyte is achieved with a reduced amount of solvent.

Figure 4:
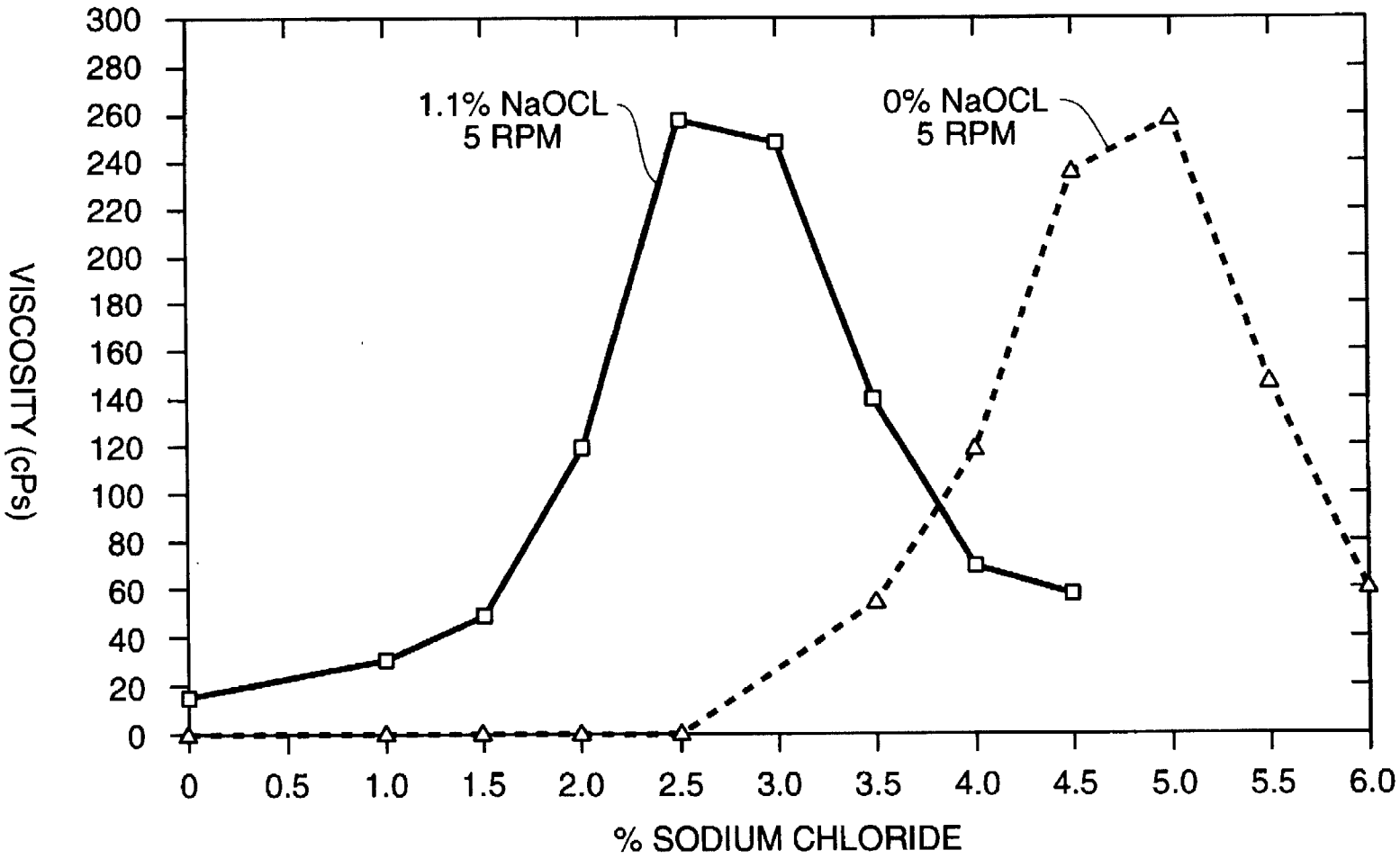
FIG. 4 is a further graphical representation illustrating the effects of varying amounts of sodium chloride as a monovalent electrolyte, with and without a hypochlorite bleach, in a thickened aqueous cleaning composition according to the present invention.

Thickening effects of compositions described herein as Examples 8 and 9 are graphically illustrated in FIG. 4 by solid and dashed lines, respectively.

The composition for each of Examples 8 and 9 includes 1.5% by wt. alkyl ether sulfate surfactant, TEXAPON N-70, 0.75% by wt. sodium hydroxide and a varying amount of sodium chloride as an added monovalent electrolyte. The composition of Example 8 in addition includes 1.1% by wt. of sodium hypochlorite. Accordingly, the composition of Example 8 is provided with a bleaching capability not present in the composition of Example 9.

The thickening effects illustrated in FIG. 4 for Examples 8 and 9 initially indicates that hypochlorite bleach is not essential in the composition in order to achieve thickening. Rather, thickening is accomplished in accordance with the present invention by the combination of an alkyl ether sulfate surfactant, a solvent as specified and an electrolyte component which may be selected from monovalent or multivalent species. In addition, FIG. 4 illustrates that an optimum range of thickening is accomplished with the two different electrolyte systems of Examples 8 and 9, again in accordance with the present invention.

Examples 10–13 are illustrated in Table I together with resulting viscosities to indicate relative thickening for those examples. Generally, each of Examples 10–13 includes 1.5% by wt. of an alkyl ether sulfate surfactant, TEXAPON N-70, 0.75% by wt. sodium hydroxide and 0.1% by wt. of a solvent, tetrahydromyrcenol. In addition, Examples 11–13 include varying amounts of sodium citrate as an organic electrolyte, Example 10 serving as a reference without the addition of sodium citrate.

TABLE I

| Example | AEOS[1] (% by wt.) | Sodium hydroxide (% by wt.) | Solvent[2] (% by wt.) | Sodium citrate (% by wt.) | Viscosity at 5 rpm (cps) |
|---|---|---|---|---|---|
| 10 | 1.5 | 0.75 | 0.1 | 0 | 0 |
| 11 | 1.5 | 0.75 | 0.1 | 9.5 | 24 |
| 12 | 1.5 | 0.75 | 0.1 | 10.5 | 56 |
| 13 | 1.5 | 0.75 | 0.1 | 11.5 | 104 |

[1]Alkyl ether sulfate surfactant (TEXAPON N-70)
[2]Tetrahydromyrcenol

It may be seen from Table I that sodium citrate is also an effective electrolyte according to the present invention. Increasing the amount of sodium citrate even beyond that included in Example 13 eventually results in a reduction of viscosity. Accordingly, sodium citrate is also characterized by a specific range where it achieves optimum thickening the compositions of the present invention. It may also be noted from Table I that relative large amounts of sodium citrate are included. This may be partly due to the character of the electrolyte. However, it is also important to note that Examples 10–13 do not include a bleach component or electrolyte salts normally accompanying the bleach. Accordingly, the overall percentage by wt. for the electrolyte component in Examples 10–13 remains within the preferred range for the invention.

Examples 14–41 are set forth below in Table II in order to better illustrate stability for thickened compositions according to the present invention. Certain of the compositions for Examples 14–41 are similar to certain of preceding Examples 1–13 and are included within the data of Table II in order to demonstrate stability for those compositions.

In Table II, all of Examples 14–41 include the essential combination of an alkyl ether sulfate surfactant, a solvent comprising, unless otherwise noted, a proprietary mixture of terpenes and terpeneols (hereinafter referred to as Solvent A), and an electrolyte component for achieving thickening. In addition, Table II illustrates the thickened viscosity for each of the examples both at the time of formation and after ageing in order to illustrate stability during shelf life of the product.

TABLE II

| | AEOS surf. | Solvent | $Na_2CO_3$ | Viscosity in centipoise (CPS) at 5 rpm and 21° C. | | |
|---|---|---|---|---|---|---|
| Example | % by wt. | % by wt. | % by wt. | 0 wk | 4 wk | 12 wk |
| 14 | 1.5 | 0 | 0 | 0 | 0 | 0 |
| 15 | 1.5 | 0 | 1.0 | 0 | 0 | 0 |
| 16 | 1.5 | 0.1[d] | 1.0 | 192 | 184 | — |
| 17 | 1.5 | 0.1 | 0 | 48 | 24 | 32 |
| 18 | 1.5 | 0.1 | 1.0 | 136 | 152 | 160 |
| 19[b] | 1.5 | 0 | 0 | 0 | 0 | 0 |
| 20[b] | 1.5 | 0.1 | 0 | 38 | 112 | 128 |
| 21[c] | 1.5 | 0 | 0 | 0 | 0 | 0 |
| 22[c] | 1.5 | 0.1 | 0 | 56 | 64 | 80 |
| 23 | 1.5 | 0.1 | 0 | 64 | 83 | 98 |
| 24 | 1.5 | 0.1 | 1.5 | 208 | 232 | 132 |
| 25 | 1.5 | 0.1 | 2.0 | 232 | 216 | 184 |
| 26 | 1.5 | 0.01 | 1.0 | 0 | 0 | 0 |
| 27 | 1.5 | 0.05 | 1.0 | 16 | 40 | 40 |
| 28 | 1.5 | 0.1[e] | 1.0 | 256 | 216 | — |
| 29 | 1.5 | 0.2 | 1.0 | 32 | 13 | 0 |
| 30 | 1.5 | 0.3 | 1.0 | 0 | 0 | 0 |
| 31 | 1.5 | 0.1[f] | 1.0 | 152 | 144 | — |
| 32 | 1.25 | 0.2 | 1.0 | 48 | 64 | 72 |
| 33 | 1.5 | 0.1 | 1.0 | 56 | 72 | 104 |
| 34 | 2.0 | 0.1 | 1.0 | 96 | 120 | 176 |
| 35 | 1.5 | 0.1[d] | 1.0 | 192 | 184 | 200 |
| 36 | 1.5 | 0.1[e] | 1.0 | 256 | 216 | 176 |
| 37 | 1.5 | 0.1[f] | 1.0 | 152 | 244 | 200 |
| 38 | 1.5 | 0.1[d] | 0 | 56 | 64 | — |
| 39 | 1.5 | 0.1[e] | 0 | 120 | 72 | — |
| 40 | 1.5 | 0.1[e] | 0 | 72 | 64 | — |
| 41 | 1.5 | 0.1[f] | 0 | 144 | 168 | — |

[b]Also includes 1.0% $Na_2SO_4$;
[c]Also includes 1.0% $Na_3PO_4$
[d]Tetrahydrolinalool
[e]tetrahydromyrcenol
[f]dihydroterpineol The compositions of Examples 14–41 and the stability results for those examples are further defined below.

All examples contained 0.75% by wt. sodium hydroxide and 2.2% by wt. sodium hypochlorite. Samples 19–22 further contained buffer-electrolytes as indicated.

Alkalinity and bleach strength were also monitored during stability tests for Examples 14–41. Generally, it was observed that the alkalinity for all of the examples remained in the approximate range of about 13–13.5 pH during the 12 week stability tests illustrated in Table II. At the same time, bleach strength for the examples remained effectively high throughout the 12 week tests. More specifically, an effective amount of bleach remained in the examples after 12 weeks.

Examples 1–41 as set forth above thus represent in combination novelty of the present invention in an aqueous cleaning composition including a thickening system comprising an alkyl ether sulfate surfactant, a solvent selected from the class consisting of terpene derivatives including a functional group and tertiary alcohols and an electrolyte component comprising monovalent and/or multivalent electrolytes. The thickening agent was illustrated as being effective with the electrolyte component optionally containing a hypochlorite bleach. The above examples are also representative of similar results to be achieved by other thickening components selected in accordance with the limitations set forth above.

Table III below illustrates the benefits of adding one or more cothickening surfactants to the AEOS, solvent and electrolyte thickening system. In this table, THM represents tegrahydromyrcenol; Solvent A represents the previously noted mixture of terpenes and terpeneols; SLS is a sodium lauryl sulfate; and TRITON is TRITON X-301, an ethoxylated alkylphenol sulfate salt, having about 6.5 moles of ethylene oxide per molecule and an eight carbon alkyl chain.

TABLE III

| | | | | Initial | Viscosity Stability | | | | | |
|---|---|---|---|---|---|---|---|---|---|---|
| | | | | Viscosity | 21° C. | | | | 49° C. | |
| Example | % Solvent | % Surfactant 1 | % Surfactant 2 | 5 rpm | 4 weeks | 6 weeks | 12 weeks | 15 weeks | 1 week | 2 weeks |
| 42 | 0.15 THM | 0.10 SLS | 0 | 80 | — | — | — | — | 48 | — |
| 43 | 0.15 THM | 0.25 SLS | 0 | 88 | — | — | — | — | 48 | — |

TABLE III-continued

| Example | % Solvent | % Surfactant 1 | % Surfactant 2 | Initial Viscosity 5 rpm | Viscosity Stability 21° C. 4 weeks | 6 weeks | 12 weeks | 15 weeks | 49° C. 1 week | 2 weeks |
|---|---|---|---|---|---|---|---|---|---|---|
| 44 | 0.15 THM | 0.50 SLS | 0 | 144 | — | — | — | — | 88 | — |
| 45 | 0.15 THM | 1.0 SLS | 0 | 328 | — | — | — | — | 288 | — |
| 46 | 0.06 THM | 0.25 Triton | 0 | 176 | 228 | — | 260 | — | 140 | 88 |
| 47 | 0.12 THM | 0.25 SLS | 0 | 288 | 328 | — | 268 | — | 144 | 72 |
| 48 | 0.08 THM | 0.13 Triton | 0.25 SLS | 272 | 360 | — | 408 | — | 208 | 152 |
| 49 | 0.10 Solvent A | 0.25 Triton | 0 | 128 | — | 120 | — | 120 | — | >64 |
| 50 | 0.10 Solvent A | 0.13 Triton | 0.25 SLS | 288 | — | 272 | — | 300 | — | — |
| 51 | 0.14 Solvent A | 0.25 SLS | 0 | 176 | 240 | — | 284 | — | 144 | 160 |
| 52 | 0.10 Solvent A | 0.13 Triton | 0.25 SLS | 168 | 192 | — | — | — | 152 | 152 |
| 53 | 0.10 Solvent A | 0.06 Triton | 0.13 SLS | 56 | 60 | — | — | — | 48 | 36 |
| 54 | 0.10 Solvent A | 0.13 Triton | 0.25 SLS | 68 | 84 | — | — | — | 88 | 104 |
| 55 | 0.10 Solvent A | 0.13 Triton | 0.25 SLS | 200 | 272 | — | 320 | — | 168 | 172 |
| 56 | 0.10 Solvent A | 0.13 Triton | 0 | 152 | — | 156 | — | 184 | — | — |
| 57 | 0.10 Solvent A | 0.25 SLS | 0 | 160 | — | 168 | — | 204 | — | — |
| 58 | 0.8 Solvent A | 0.25 Triton | 0 | 140 | 192 | — | 224 | — | 136 | 112 |

Examples 42–58 of Table III show the effects of including an additional surfactant or mixture of two additional surfactants to the primary thickening system comprising AEOS, solvent and electrolyte. Sodium lauryl sulfate and/or alkoxylated alkylphenol sulfate salt are thus combined with the AEOS to form binary and ternary surfactant systems, and tested with tetrahydromyrcenol or Fragrance A. Results are obtained as initial viscosity, measured immediately after sample preparation, and following storage at 21° C. or 49° C. All examples also included 1.5% AEOS, 0.75% NaOH, and 2.3% NaOCl.

In comparing results of Table II with Table III, it can be seen that greater viscosities (both initially and after storage) are obtained using the inventive combination of cothickening surfactants. Additionally, viscosity levels comparable to those developed by the primary thickening system (AEOS, solvent and electrolyte) can be achieved with the cothickening surfactant at lower total active levels. Similarly, solvent and/or electrolyte levels can be reduced while retaining viscosity by increasing levels of cothickening surfactants. In particular, compare examples 17 and 23 comprising 1.5% by wt. AEOS, 0.1% by wt. solvent A, 0.75% by wt. NaOH, and 2.2% by wt. NaOCl, with examples 49, 50 and 52–57, which include SLS and/or TRITON as cothickening surfactants. These latter examples developed much higher initial viscosities (as much as 288 cP) and the viscosities were stable over time, even at an elevated temperature. It should be noted that none of the examples of Table III contain sodium carbonate as electrolyte, which as previously discussed is highly preferred, in part for its contribution to viscosity development. Table II, by contrast, shows examples both with and without sodium carbonate. Note, however, that the surprising improvement by the cothickening surfactant(s) meets and often exceeds the thickening contribution of the sodium carbonate. Cothickening surfactant examples 45, 47 and 50 yielded initial viscosities of 328, 288 and 288 cP, respectively, compared with initial viscosities of 232 and 256 cP of examples 25 and 28 (Table II), respectively, having added sodium carbonate, but AEOS only as sole surfactant.

Table IV below provides further detail regarding the advantage afforded by the cothickening surfactant in achieving high viscosities at lower solvent levels. Examples 59–61 of Table IV all contain 1.5% by wt. AEOS, 0.75% by wt. sodium hydroxide, 2.3% by wt. sodium hypochlorite, and the indicated levels of cothickening surfactants and solvent. Viscosities were measured initially at 21° C. using a Brookfield RVT viscometer at 5 rpm.

TABLE IV

| Example | Solvent | Peak Viscosity cP @ wt. % of Solvent: One Surfactant[a] | Two Surfactants[b] |
|---|---|---|---|
| 59 | Fragrance A | 280 @ 0.143 | 345 @ 0.103 |
| 60 | THL | 280 @ 0.121 | 365 @ 0.090 |
| 61 | THM | 375 @ 0.095 | 440 @ 0.085 |

[a] = 0.251 SLS
[b] = 0.126 Triton + 0.253 SLS

Table IV illustrates the shift in peak viscosity of the thickening system to a lower solvent level when using two cothickening surfactants compared to a single cothickening surfactant.

There have accordingly been discussed above a number of embodiments and illustrative examples of formulations of liquid cleaning and/or bleach compositions according to the present invention. Additional variations and modifications of those embodiments and examples in accordance with the invention will be apparent in addition to those specifically set forth above. Accordingly, it is to be understood that the above disclosure of the invention is not limiting but is set forth in order to facilitate an understanding of the invention. The scope of the invention including modifications and additions as noted above is defined by the following appended claims.

What is claimed is:

1. A thickened aqueous cleaning composition comprising about 0.1 to about 10% by wt. of an alkyl ether sulfate surfactant; about 0.01 to about 10% by wt. of a bleach stable solvent selected from the group consisting of terpene derivatives including a functional group and tertiary alcohols; about 0.1 to 5.0% by wt. of a cothickening surfactant consisting essentially of at least one of an octyl or nonyl alkylphenol sulfate salt having an EO of 6.5 to 10; and about 0.1 to 30% by wt. of an electrolyte component comprising at least one alkali metal hypochlorite in an amount effective to enhance thickening by the alkyl ether sulfate surfactant, cothickening surfactant and solvent.

2. A method of cleaning which comprises the step of employing a thickened aqueous cleaning composition comprising about 0.1 to about 10% by wt. of an alkyl ether sulfate surfactant; about 0.01 to about 10% by wt. of a bleach stable solvent selected from the group consisting of terpene derivatives including a functional group and tertiary alcohols; about 0.1 to 5.0% by wt. of a cothickening surfactant consisting essentially of at least one of an octyl or nonyl alkylphenol sulfate salt having an EO of 6.5 to 10 and; and about 0.1 to 30% by wt. of an electrolyte component comprising at least one alkali metal hypochlorite in an amount effective to enhance thickening by the alkyl ether sulfate surfactant, cothickening surfactant and solvent.

3. The method of claim 2 wherein the electrolyte component further comprises sodium hydroxide as a monovalent electrolyte to stabilize the hypochlorite.

4. The thickened aqueous cleaning composition of claim 1 wherein the terpene derivatives are saturated.

5. The method of claim 2 wherein the electrolyte component further comprises a first multivalent electrolyte in addition to the alkali metal hypochlorite.

6. The thickened aqueous cleaning composition of claim 1 wherein the alkyl ether sulfate surfactant forms from about 0.25 to about 3% by wt. of the composition, the solvent forms from about 0.05 to about 0.5% by wt. of the composition, the cothickening surfactant forms about 0.5 to 2.0% by wt. of the composition, and the electrolyte component forms from about 1.0 to about 12% by wt. of the composition.

7. The method of claim 5 wherein the first multivalent electrolyte is sodium carbonate.

8. The method of claim 2 wherein the terpene derivatives are saturated.

9. The method of claim 2 wherein the alkyl ether sulfate surfactant forms from about 0.25 to about 3% by wt. of the composition, the solvent forms from about 0.05 to about 0.5% by wt. of the composition, the cothickening surfactant forms from about 0.1 to 2.5% by wt. of the composition, and the electrolyte component forms from about 1.0 to about 12% by wt. of the composition.

10. The thickened aqueous cleaning composition of claim 1 wherein the electrolyte component further comprises a first multivalent electrolyte in addition to the alkali metal hypochlorite.

11. The thickened aqueous cleaning composition of claim 10 wherein the first multivalent electrolyte is sodium carbonate.

12. The method of claim 2 wherein the alkyl ether sulfate surfactant has an alkyl component with about 8–18 carbons and an alkylene oxide component with about 1–4 alkylene oxide monomers.

13. The method of claim 12 wherein the alkyl component is a linear chain having about 12–16 carbons and the alkylene oxide component is ethylene oxide.

14. The thickened aqueous cleaning composition of claim 1 wherein the alkyl ether sulfate surfactant has an alkyl component with about 8–18 carbons and an alkylene oxide component with about 1–4 alkylene oxide monomers.

15. The thickened aqueous cleaning composition of claim 1 wherein the electrolyte component further comprises sodium hydroxide as a monovalent electrolyte to stabilize the hypochlorite.

16. The thickened aqueous cleaning composition of claim 14 wherein the alkyl component is a linear chain having about 12–16 carbons and the alkylene oxide component is ethylene oxide.

* * * * *